US009638072B2

(12) United States Patent
Sailer et al.

(10) Patent No.: US 9,638,072 B2
(45) Date of Patent: May 2, 2017

(54) ROLLER TAPPET FOR A RECIPROCATING-PISTON COMBUSTION ENGINE

(71) Applicant: Schaeffler Technologies AG & Co. KG, Herzogenaurach (DE)

(72) Inventors: Peter Sailer, Erlangen (DE); Oliver Schnell, Veitsbronn (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 14/669,100

(22) Filed: Mar. 26, 2015

(65) Prior Publication Data

US 2015/0285104 A1 Oct. 8, 2015

(51) Int. Cl.

| | |
|---|---|
| ***F01L 1/18*** | (2006.01) |
| ***F01L 1/16*** | (2006.01) |
| ***F01L 1/14*** | (2006.01) |
| *F01L 1/24* | (2006.01) |

(52) U.S. Cl.

CPC ..... *F01L 1/16* (2013.01); *F01L 1/146* (2013.01); *F01L 2001/2427* (2013.01); *F01L 2105/02* (2013.01)

(58) Field of Classification Search

CPC ..... F01L 1/16; F01L 1/146; F01L 2105/02; F01L 2001/2427

See application file for complete search history.

(56) References Cited

U.S. PATENT DOCUMENTS 5,960,758 A * 10/1999 Giannone ..... F01L 1/14 123/90.42
2003/0051689 A1* 3/2003 Schnell ..... F01L 1/146 123/90.48

FOREIGN PATENT DOCUMENTS

DE 102007003969 7/2008

* cited by examiner

*Primary Examiner* — Zelalem Eshete
(74) *Attorney, Agent, or Firm* — Volpe and Koenig, P.C.

(57) ABSTRACT

A tappet (1) for a reciprocating-piston combustion engine, which is situated within a tappet guide of a component fixedly attached to the engine, and having a bearing-mounted roller (8) guided on a pin (3), which roller is in active contact with a cam or an eccentric of a shaft of the reciprocating-piston combustion engine. The casing surface of the cam or eccentric is implemented axially parallel to the shaft and the roller (8) is guided so as to oscillate on the pin (3).

6 Claims, 3 Drawing Sheets

ROLLER TAPPET FOR A RECIPROCATING-PISTON COMBUSTION ENGINE

INCORPORATION BY REFERENCE

The following documents are incorporated herein by reference as if fully set forth: German Patent Application No. 102014206315.9, filed Apr. 2, 2014.

BACKGROUND

The invention relates to a tappet which is situated within a tappet guide of a component fixedly attached to the engine, and having a bearing-mounted roller guided on a pin, which roller is in active contact with a cam or an eccentric of a shaft of the reciprocating-piston combustion engine, wherein the casing surface of the cam or eccentric is implemented axially parallel to the shaft.

Tappets of this type, with rollers that are situated bearing-mounted on a pin of the tappet, are generally known. Due to the guiding of the tappet in the tappet guide/borehole, misalignments of the roller relative to the cam or eccentric can arise as a result of tolerances, resulting in eccentric loading of the roller, roller bodies, and pin. Attempts have been made to compensate for this eccentric loading by using a convexity on the outer circumference of the roller. However, this leads to a lop-sided loading of the pin and roller bodies, resulting in increased wear.

SUMMARY

The object of the invention is therefore to improve on the tappet of the design described in the introduction in such a way that the disadvantages mentioned are eliminated. The intention is to provide a simple and cost-effective embodiment.

The object according to the invention is achieved in that the roller is guided so as to oscillate on the pin. In this way, the roller can adapt to the casing surface of the cam or eccentric and transmit the force centrally onto the pin.

It is indeed known from DE 10 2007 003 969 to mount rollers which come into contact with the cams of a camshaft rotatably on a rocker arm. Either two rollers are thereby situated in one roller recess which are rotatably guided in a bed on the cam follower, or each of the rollers has its own roller recess which rollers are individually mounted rotatably on the cam follower. This rotatable mounting of the rollers has nothing to do with tolerance adjustment, but instead serves to adapt the rollers to the outer circumference of a spatial cam, which outer circumference is implemented at an incline relative to the shaft axis in order to adjust the valve lift. It is thereby indeed also proposed to guide the roller in an oscillating manner. However, this is carried out using a conventional self-aligning roller bearing. Guiding of this type is extremely expensive and makes the most sense in connection with a valve-lift adjustment.

According to an embodiment of the invention, the roller, roller bodies, and an inner ring are connected to one another at a fixed angle. This does not mean that the roller, roller bodies, and inner ring are implemented so as to be oscillating, but rather that the inner ring is guided so as to be oscillating relative to the pin.

The inner ring thereby has a concave inner surface which is in contact with a convex outer surface of an intermediate ring. By this means, the roller, roller bodies, and inner ring may assume the full loading capacity and adjust to the casing surface of the cam or eccentric, and thereby transmit a possible, tolerance-determined angular deviation to the concave and convex surfaces of the inner ring and the intermediate ring.

The intermediate ring has a longitudinal slit which is situated outside of the loading zone of the roller or the roller bearing in the operating state. The longitudinal slit of the intermediate ring helps to be able to introduce or insert the intermediate ring with its convex outer surface into the concave inner surface of the closed inner ring. The intermediate ring is thereby elastically flexible and the longitudinal slit has a width such that this insertion is possible.

The intermediate ring for its part is situated on the pin by means of an interference fit, so that the position of the intermediate ring on the pin is fixed, as a result of which the situation of the longitudinal slit outside of the loading zone is also assured.

Advantageously, the pin with its ends is caulked to the tappet or tappet shoulders so that the rotational support and an axial support of the intermediate ring relative to the tappet are also ensured.

For the sake of simplicity, the roller is designed as an outer ring of the roller bearing, reducing the number of parts.

DETAILED DESCRIPTION OF THE PREFERRED EMBODIMENTS

Figure 1:
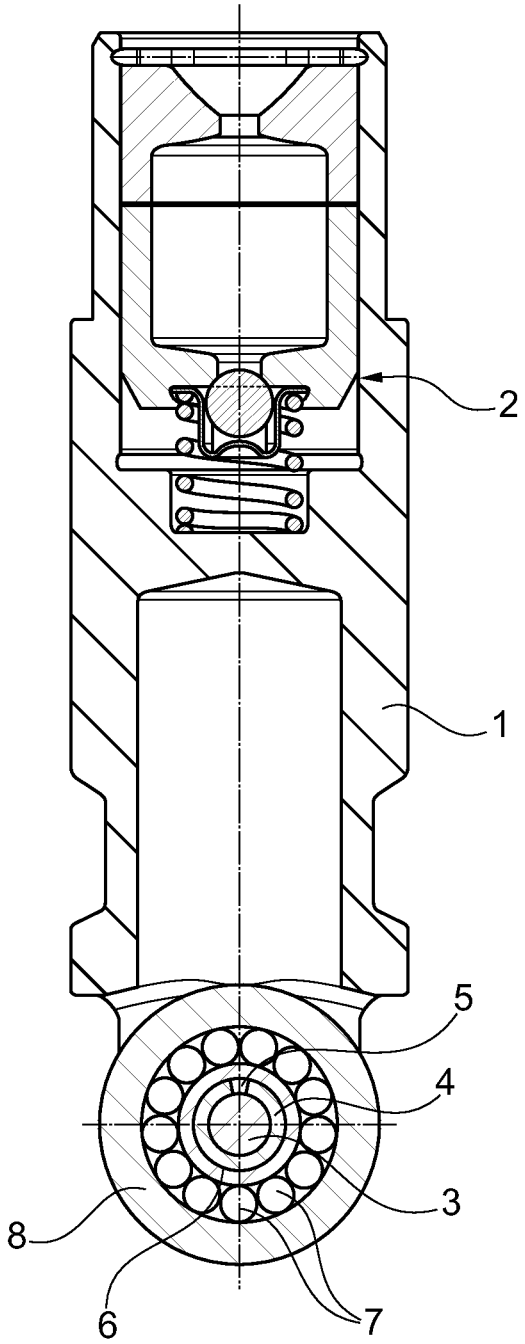
FIG. 1 is a longitudinal section through a tappet with a roller guided so as to be oscillating.
Figure 2:
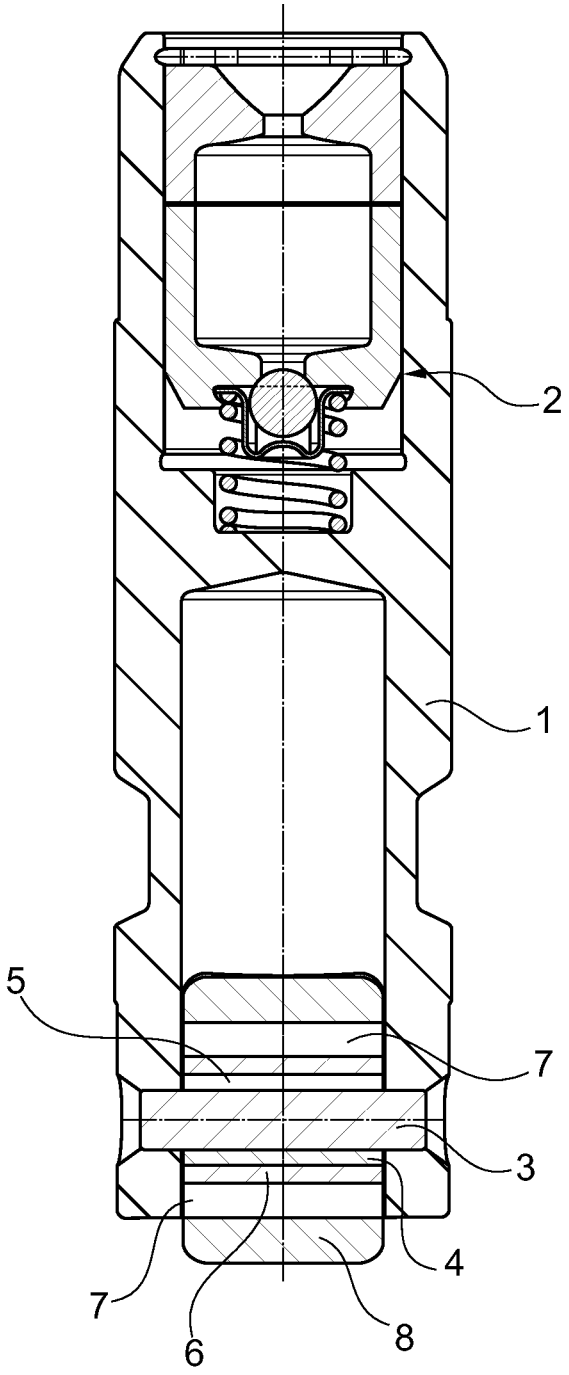
FIG. 2 is a longitudinal section through the tappet, which is rotated 90° relative to FIG. 1.
Figure 4:
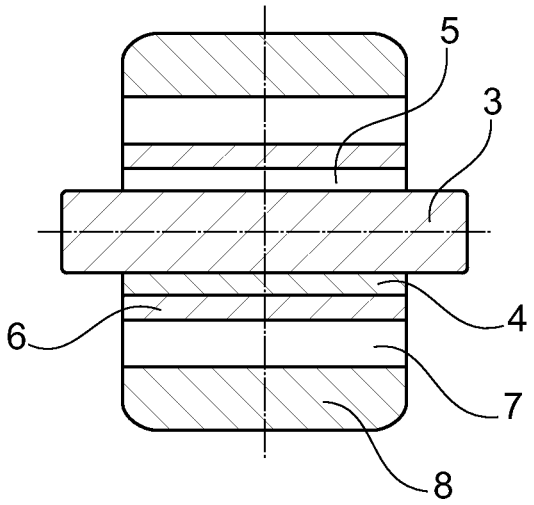
FIG. 4 is a section similar to FIG. 3, which is rotated by 90°.
Figure 3:
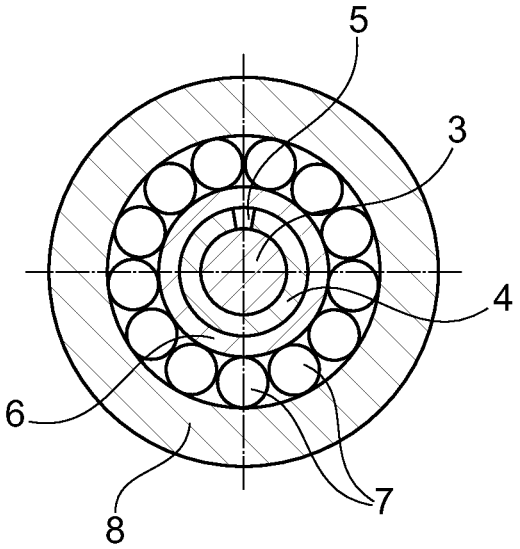
FIG. 3 is a cross section through the roller bearing-guided roller, with the cut through an intermediate ring and the pin.

In FIGS. 1 to 4, when individually represented, 1 designates a tappet, which has at its one end a hydraulic play compensation device 2, which is not the subject matter of the present invention. Therefore, the hydraulic play compensation device is not described here in more detail.

A pin 3, which is inserted into openings of tappet 1 and is caulked at its ends with tappet 1, is situated in a recess at the other end of tappet 1.

An intermediate ring 4 having a longitudinal slit 5 is situated on pin 3. Intermediate ring 4 is implemented as convex on its outer circumference and is in contact with an inner ring 6 of a roller bearing arrangement, the inner surface of this inner ring is concave, adapted to the convex outer surface of intermediate ring 4.

Roller bodies 7, on which a roller 8 may roll, are guided on the inner ring 6, and this roller simultaneously forms the outer ring of the roller-bearing arrangement.

A longitudinal slit 5 in intermediate ring 4 is designed wide enough so that the intermediate ring 4 may be pressed into the inner ring 6 of the roller-bearing arrangement, whereby the intermediate ring 4 may correspondingly deform elastically.

The pin 3 is pressed into the intermediate ring 4 according to a precise fit situation of the intermediate ring into the opening of tappet 1. The intermediate ring 4 is thereby situated so that the longitudinal slit 5 is outside the loading zone of the inner ring 6.

LIST OF REFERENCE NUMBERS

1) Tappet
2) Hydraulic play compensation device
3) Pin
4) Intermediate ring
5) Longitudinal slit
6) Inner ring
7) Roller body
8) Roller

The invention claimed is:

1. A tappet for a reciprocating-piston combustion engine, situated within a tappet guide of a component fixedly attached to the engine, the tappet comprising a bearing-mounted roller guided on a pin, roller bodies, and an inner ring located within the roller that are connected to one another at a fixed angle, wherein the inner ring has a concave inner surface which is in contact with a convex outer surface of an intermediate ring, and wherein said roller is in active contact with a cam or an eccentric of a shaft of the reciprocating-piston combustion engine, a casing surface of the cam or eccentric is implemented axially parallel to the shaft, and the roller is guided so as to oscillate on the pin, and the roller bodies and an inner ring located within the roller are connected to one another at a fixed angle.

2. The tappet according to claim 1, wherein the inner ring is guided so as to be oscillating relative to the pin.

3. The tappet according to claim 1, wherein the intermediate ring has a longitudinal slit situated outside of a loading zone of the inner ring in an operating state.

4. The tappet according to claim 1, wherein the intermediate ring is situated on the pin by an interference fit.

5. The tappet according to claim 1, wherein the pin is caulked at its ends to the tappet.

6. The tappet according to claim 1, wherein the roller forms an outer ring of a roller bearing.

* * * * *